United States Patent [19]

Polonsky

[11] Patent Number: 5,031,487

[45] Date of Patent: Jul. 16, 1991

[54] BROKEN BOLT EXTRACTOR

[75] Inventor: Eli Polonsky, Aurora, Colo.

[73] Assignee: Alden Corporation, Wolcott, Conn.

[21] Appl. No.: 537,243

[22] Filed: Jun. 13, 1990

Related U.S. Application Data

[63] Continuation-in-part of Ser. No. 430,258, Nov. 2, 1989, abandoned.

[51] Int. Cl.[5] ..... B25B 13/50

[52] U.S. Cl. ..... 81/53.2; 7/158

[58] Field of Search ..... 7/158; 81/53.2, 441; 408/22, 67

[56] References Cited

U.S. PATENT DOCUMENTS 4,604,917 8/1986 Polonsky ..... 81/53.2

4,777,850 10/1988 Polonsky ..... 81/53.2

*Primary Examiner*—James G. Smith

*Attorney, Agent, or Firm*—Dallett Hoopes

[57] ABSTRACT

A broken bolt extractor comprises a right-hand threaded shaft having a left-hand drill bit at its lower end, the bit superposed by a collet-spreading inclined surface. The shaft has an invertible collet threaded thereon. The collet tapers toward its lower end and carries thereon exterior left-hand threads and is longitudinally split and expandable. The upper end of the collet carries a drive head structured when the collet is inverted on the shaft to center the drilling as it engages the sides of an aligned opening in a mating flange.

6 Claims, 1 Drawing Sheet

BROKEN BOLT EXTRACTOR

CROSS-REFERENCES TO RELATED APPLICATION

This application is a continuation-in-part of application Ser. No. 430,258 filed Nov. 2, 1989, now abandoned.

BACKGROUND OF THE INVENTION

1. Field of the Invention

The present invention relates to extractors for removing broken threaded fasteners such as broken bolts, and more particularly, to a broken fastener extractor comprising a drill head with a collet to grab the bolt, and including guide means for starting the drill in the center of the broken bolt.

2. Description of Related Art including Information Disclosed under §§1.97 to 1.99

The present invention is an improvement over my prior U.S. Pat. Nos. 4,604,917 issued Aug. 12, 1986 and 4,777,850 issued Oct. 18, 1988.

When the drive head is broken off a bolt, it becomes a difficult, time-consuming process to remove the stud portion of the bolt which remains in the threaded bore beneath the support surface where the bolt had originally been inserted. Conventionally, removal of the stud requires that a hole be drilled through the stud. After the drill bit is removed, an "easy-out"-type bolt extractor is used for removal. Such bolt extractors are formed with gripping teeth and/or shaped flutes adapted to engage the sides of a drilled bore in the broken bolt stud. The gripping surfaces remove the threaded bolt when the extractor is rotated in the direction opposite to that of the bolt threads.

Shortcomings of such tools are many. The drill bit is often broken in the process of drilling. This results in the two-fold problem of removal of both the broken bolt stud and removing the broken drill bit. Even when the drill bit is not broken, the bolt stud is often driven deeper into the threaded hole during the drilling process, making extraction more difficult. Many extractors require that the drilled hole be threaded, requiring an additional step of using a tap wrench to form the threads. Hence, always many separate tools and many steps are required. The many steps are tedious, time consuming and frustrating, and results are often unsatisfactory.

Herethroughout for clarity and simplicity, the bolt or stud will be considered as having right-hand threads—as by far the dominant number of bolts and studs do—and hands of threads and directions of rotation will be used as is appropriate for broken bolts with right-hand threads. This is in no way limiting: if the stud has left-hand threads, the hands of thread and directions of rotation will be opposite those taught herein.

The two above-mentioned patents describe inventions which combine a drill for forming a bore within a broken right-hand bolt stud and a bolt stud extractor for removing the broken bolt in a single combination tool, thereby enabling one to remove the broken bolt in one operation. The lower portion of the tool is provided with a drill bit having a cutting edge threaded with a pitch in a left hand direction (opposite to the threads of the broken right-hand bolt stud being extracted). In patent 4,777,850 the drill bit body is on the lower end of a threaded shaft the upper portion of which is structured to be connected to a suitable counterclockwise hand tool or power-driven tool.

A bolt extractor collet is threadedly mounted on the right-hand threaded shaft above the drill bit. The diameter of the lower portion of the gripping collet is less than the outside diameter of the drill bit which enables the collet to enter the bore formed in the broken bolt stud. The extractor collet is formed of a series of longitudinal segments separated by slots. The upper portion of the drill bit head is formed with an expander surface structured to engage and expand the longitudinal segments of the expander collet.

Preparatory to removing a broken bolt which remains within a threaded bore, the upper end of the shaft of the extractor is connected to a suitable hand or power drive tool.

To remove the broken bolt stud which remains in the bore, the drill bit engages the stud and rotates to form a bore within the body of the broken bolt stud. As the tool penetrates within the broken bolt stud, the extractor collet, which is threadedly mounted on the drill shaft, engages the interior of the hole being bored in the stud. Continued rotation of the tool causes the extractor collet to be "screwed" down toward the drill bit at the lower end of the shaft. Further rotation of the collet relative to the shaft causes the shaft to rise and the ends of the segments on the extractor collet to engage the expander surface on the drill bit body. This causes the segments to spread, thereby securely gripping the interior bore in the broken bolt stud just formed by the drill bit.

At that point, continued rotation of the drive means in the opposite direction with respect to the broken bolt stud threads simply "unscrews" the stud out of its threaded bore. The upper end of the expander collet serves to provide an additional surface for gripping by a hand tool, if needed, and also provides a means for separating the expander collet from the broken bolt stud after the stud has been removed. This is done by rotating the collet and stud member in opposite directions.

SUMMARY OF THE PRESENT INVENTION

The above mentioned patents, U.S. Pat. Nos. 4,604,917 and 4,777,850, describe totally meritorious inventions. The present invention relates to improved guide means to guide the drill bit in making its initial contact with the stud so that the drilled bore will be in the center thereof. This guide means is in the form of an enlargement on the upper end of the collet which, when the collet is inverted, engages in the aligned opening of an adjacent flange as the drilled hole is started. Further, the invention relates to improved gripping means on the outside of the collet preferably in the form of left-hand threads or fluttings.

BRIEF DESCRIPTION OF THE DRAWINGS

Other features and objects of the invention will be apparent from the following specification and drawings, all of which disclose a non-limiting embodiment of the invention. In the drawings.

DESCRIPTION OF THE PREFERRED EMBODIMENT

Figure 1:
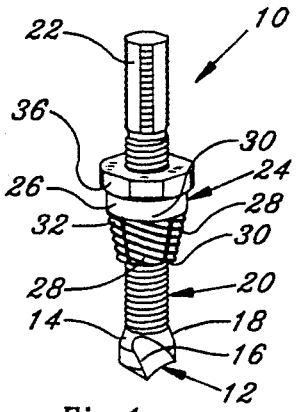
FIG. 1 is a perspective view of the bolt extractor combination tool of the present invention.
Figure 2:
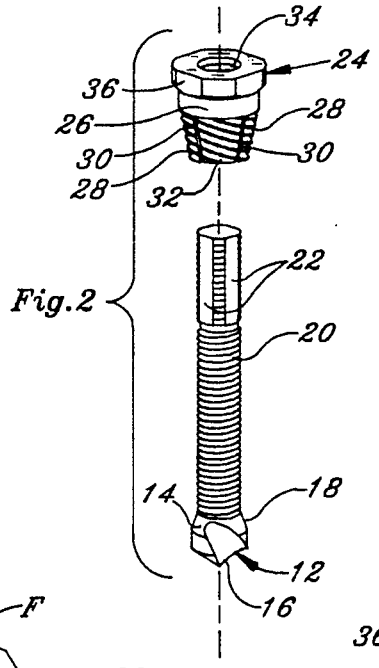
FIG. 2 is an exploded view of FIG. 1.
Figure 3:
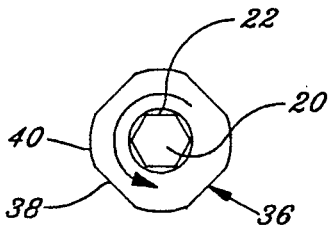
FIG. 3 is an enlarged top plan view of FIG. 1.
Figure 4:
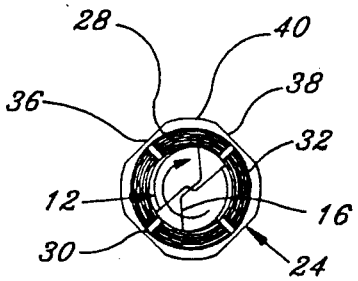
FIG. 4 is an enlarged bottom view of FIG. 1.

FIG. 1 to 4 illustrate the threaded broken bolt extractor tool 10 of the present invention. The extractor 10 includes a drill bit 12 having a left-hand or counterclockwise cutting pitch. The drill bit 12 includes a body portion 14 and cutting edges 16. The body portion 14 of the drill bit 12 is formed with a sloping expander surface 18 and is integrally attached to a threaded shaft 20. The expander surface 18 slopes outwardly from the zone where the drill body 14 meets the threaded shaft 20 toward the cutting edges 16 of the bit 12.

The upper end of the shaft 20 is preferably hexagonal (FIG. 3), formed with flat surfaces 22 to facilitate the gripping of the extractor tool 10 by a suitable driving means such as a counterclockwise power tool chuck or hand-driven wrench or drill. The extractor tool 10 includes an extractor collet 24 formed of a tapered body 26 terminating in a series of segments 28 separated by longitudinal slots 30. The collet 24 is provided with a series of helically disposed gripping flutes or left-hand threads 32 having sharp edges and extending from the bottom, to a point adjacent the top of each of the segments 28. The separation of each of the segments 28 by slots 30 provides a degree of resiliency to the end of the segments which proves useful in gripping the broken bolt stud as described hereinbelow.

The extractor collet 24 includes an internal threaded bore 34 which permits the collet to be reciprocally and rotatably movable along the longitudinal axis of the threaded shaft 20. The upper section of the expander collet 24 includes an enlarged drive head 36 having a plurality of flat sides 38 making it suitable to be gripped and rotated by a suitable tool. Intermediate the flat sides, the head is rounded as at 40, as shown, to less than the diameter of an opening O in a mating flange F (FIG. 5).

Figure 5A:
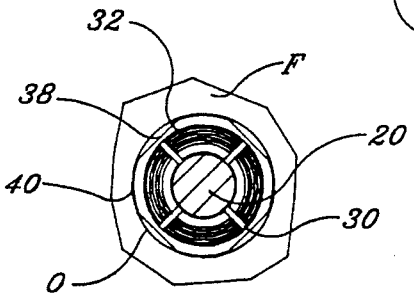
FIG. 5*a* is an enlarged sectional view taken on the line 5*a*—5*a* of FIG. 5.
Figure 5:
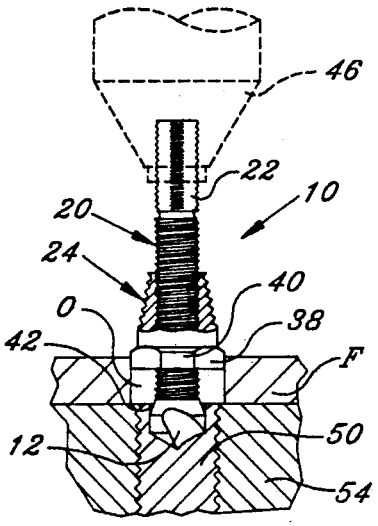
FIG. 5 is a view of the combination tool of the present invention used to remove a broken bolt stud showing the collet inverted and the guide means in use in the opening of an adjacent flange, the tool initially penetrating the stud.
Figure 6:
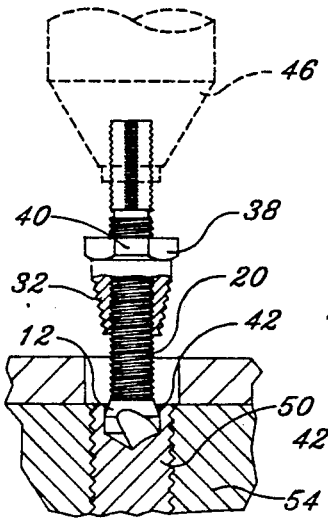
FIG. 6 shows the drilling proceeding with the collet right side up.
Figure 7:
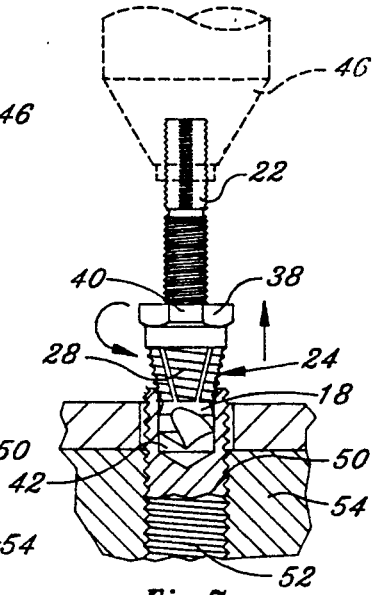
FIG. 7 is a view of the tool extracting the broken bolt stud.

Referring to FIGS. 5, 6 and 7, a broken bolt stud 50 is shown embedded within a threaded bore 52 in a supporting surface 54.

In the extracting operation to be described, the extractor tool 10 of the present invention is mechanically coupled to the chuck 46 of a suitable hand or power tool. It will be appreciated that the flat surfaces 22 on the shaft 20 are gripped by the chuck in a conventional, well-known manner to transfer a rotational driving force from the drive tool to the extractor tool 10. Assuming again that the broken stud 50 has right-hand threads, the driving tool is rotated in a left-handed or counterclockwise direction to drive the drill bit 12 into the stud 50.

Prior to inserting the shaft 20 into the chuck of a drill, the collet 24 is inverted (FIG. 5) so that when the extractor is inserted in the bolt hole, the rounded portions 40 of the enlarged drive head fit closely inside the walls of opening O in the flange F. At the commencement of the drilling, of course, the collet and the bit will be close together (i.e. closer than shown in FIG. 5) so that the collet will engage the wall of opening O as the bit first engages the stud 50. The collet centers the extractor including the drill bit 12 so that the bore will be started in the center of the stud. Also, because the break in the top of the stud may be irregular, the rounded portions 40 help the drill operator keep the drill tip from drifting "downhill" as the drilling commences. The dimensions are preferably such that the collet 24 rotates freely in the opening O with only a small clearance. As the drill bit 12 penetrates into the stud 50 (FIG. 6), the bore 42 is started.

Next, the extractor is raised from opening O, and the shaft taken out of the drill chuck. The collet is rotated off the shaft 20, inverted to the position shown in FIG. 6 and the extractor is reinstalled into the chuck. Drilling is continued. The extractor collet 24 is carried on the threaded shaft near the bit. The ends of the segments 28 eventually enter the bore 42 in the stud 50 and engage the side walls thereof. At this point, continued rotation of the driving tool causes the drilling to stop and the extractor collet 24 moves along the threads toward the drill bit 12 as the bit raises.

At the point where the lower edge of the segments 28 engage the sloping expander surface 18, the segments 28 move outwardly as they ride up on the expander surface 18 thereby securing the grip on the interior walls of the bore 42 formed within the stud 50. The gripping is enhanced by the left-hand threads 32 on the outside of the collet which tend to bite into the stud around the drilled bore 42. Thereafter, continued rotation of the driving tool unthreads the stud 50 out of the larger bore 52 in the supporting surface 54.

The drive head 36 on the extractor collet 24 may be used to either obtain a firmer grip against the interior wall surface of the bore 42 if, for example, a hand-driven drive means is used, or the drive head may be used to disengage the extractor collet from the broken stud once the stud is removed.

It will be appreciated that although a single embodiment has been disclosed, the invention is not so limited. Various changes and modifications may be made. The invention may, therefore, be defined as having the scope of the following claim language including reasonable equivalents thereof.

What is claimed is:

1. In combination, (a) a structure having a threaded bore therein and a broken bolt in the bore, (b) a flange butted against the structure having an opening in alignment with the bore and normally receiving an upper portion of the bolt to secure the flange to the structure, and (c) a broken-bolt extractor comprising:

(1) a shaft threaded in a first hand and formed at its lower end with a drill bit having the opposite hand, the bit being superposed by an outwardly and and downwardly sloping collet-spreading surface, the upper end of the shaft having a cross-section with peripheral flats to be engaged by a driving chuck, (2) a bolt-gripping collet internally threaded to cooperate with the threads on the shaft, the collet having one end tapered and longitudinally split to be spread as the end engages the collet-spreading surface, the other end of the collet having its greatest diameter substantially larger than the diameter of the drill bit and the same dimension as the diameter of the opening in the flange whereby with the collet threaded on the shaft and said other end of the collet down, the engagement of the said other end of the collet with the margins of the opening in the flange guides the drilling of the bit toward the center line of the broken bolt.

2. The combination of claim 1 wherein the tapered end of the collet is formed with threads on its outer surface, the the collet is formed with threads on its outer surface, the last-named threads being of the said opposite hand.

3. The combination of claim 1 wherein the said other end of the collet is formed with diametrically opposite flats to be engaged by a driving tool.

4. A tool assembly for extracting a broken threaded fastener threaded in a first direction of tightening in an outer bore, the assembly comprising:

(a) drill means for forming an inner bore in the broken fastener upon rotation in a second direction opposite to the first direction.

(b) shaft means threaded in the first direction and extending from the drill means, (c) coupling means for coupling a drive tool to the end of the shaft means remote from the drill means, (d) extractor means threaded on the shaft means formed with a base having an outer diameter substantially larger than the outer diameter of the drill and including outwardly spreadable gripping means for gripping the interior of the inner bore so as substantially to prevent rotation of the extractor means relative to the fastener, the gripping means having threads thereon of the second direction, and (e) fusto-conical expander means intermediate the drill means and shaft and tapering toward the shaft for engaging the gripping means, the expander means expanding the gripping means for gripping the fastener by the interior of the bore whereby continued rotation of the drive means in the second direction extracts the fastener from the outer bore.

5. The tool assembly of claim 4 wherein said base of the extractor means is characterized by a plurality of diametrically opposite flat sides.

6. The method of removing a broken bolt from a threaded bore in a base structure, the structure having a flange secured thereto with an opening aligned with the threaded bore, comprising the steps of, (1) rotating in the bore in a left-hand direction and urging downward a left-hand drill having a shaft with right-hand threads and having a fusto-conical expander surface between the drill and shaft tapering toward the shaft, the shaft having threaded thereon a collet having a base the diameter of the opening and from the base an upwardly tapering gripping element having left-hand threads on its surface and a plurality of longitudinal splits therein, the base in engagement with the opening serving to center the drill in the center of the broken bolt to drill a hole in the bolt;

(2) removing the drill from the bore after the hole is started and inverting the collet on the shaft;

(3) resuming the drilling in the hole until the gripping element, engaged by the wall of the hole stops rotating and is forced down by the right-hand threads on the shaft and the tapering gripping element spreads as it engages the expander surface to engage the wall of the hole more firmly; and (4) continuing left-hand rotation of the drill to back the broken bolt out of the structure.

* * * * *